US005489075A

United States Patent [19]

Ible

[11] Patent Number: 5,489,075

[45] Date of Patent: Feb. 6, 1996

[54] BABY BOTTLE HOLDER AND FEEDER

[76] Inventor: Robert L. Ible, c/o Steve Rue, 2304 Atlee Rd., Mechanicsville, Va. 23111-2507

[21] Appl. No.: 276,858

[22] Filed: Jul. 18, 1994

[51] Int. Cl.[6] ..... A47D 15/00

[52] U.S. Cl. ..... 248/104; 24/298; 24/339; 24/510; 248/229.23

[58] Field of Search ..... 248/103, 104, 248/229, 231.5, 160, 62, 63, 74.1, 74.2; 224/275; 24/298, 507, 510, 339, 129 D; 403/405.1

[56] References Cited

U.S. PATENT DOCUMENTS

| | | | |
|---|---|---|---|
| 980,162 | 12/1910 | Meyer | 248/229 |
| 1,224,431 | 5/1917 | Vorst | 248/160 |
| 1,786,459 | 12/1930 | Simons | 248/104 |
| 2,110,037 | 3/1938 | De Rosa | 248/104 |
| 2,258,076 | 10/1941 | Taylor et al. | 248/104 |
| 2,759,765 | 8/1956 | Pawley | 248/160 |
| 2,815,777 | 12/1957 | Iraids | 24/507 X |
| 3,111,296 | 1/1963 | Luder | 248/103 |
| 3,398,919 | 8/1968 | Tokar | 248/103 |
| 3,649,954 | 3/1972 | Kurtz | 24/510 X |
| 4,482,117 | 11/1984 | Besek, Jr. | 248/103 |
| 5,016,845 | 5/1991 | Pelligrino | 248/10 X |
| 5,135,189 | 8/1992 | Ghazizadeh | 248/10 X |

*Primary Examiner*—Ramon O. Ramirez
*Assistant Examiner*—Korie H. Chan

[57] ABSTRACT

A baby bottle holder and feeder including a lightweight, hollow articulating arm having a clamp member affixed at one end for the purpose of holding a baby bottle for feeding and having another clamp member affixed at the opposite end for the purpose of clamping the baby bottle holder and feeder to a nearby object such as a baby's car seat. The articulating arm is generally of plastic composition and permits movement by a child as required to initiate, perform, and terminate self feeding. The clamp member holding the baby bottle is spring actuated and having pads between planar extensions of the jaws of the clamp member for softening impact therebetween subsequent to removal of the bottle should an older child desire such release.

1 Claim, 4 Drawing Sheets

BABY BOTTLE HOLDER AND FEEDER

BACKGROUND OF THE INVENTION

1. Field of the Invention

The present invention relates to baby bottle holders and feeders and more particularly pertains to a baby bottle holder and feeder which may be employed to hold a baby bottle in a position from which substantially unattended feeding may be accomplished.

2. Description of the Prior Art

The use of baby bottle holders and feeders is known in the prior art. More specifically, baby bottle holders and feeders heretofore devised and utilized for holding a baby bottle in position for substantially unattended feeding are known to consist basically of familiar, expected and obvious structural configurations, notwithstanding the myriad of designs encompassed by the crowded prior art which have been developed for the fulfillment of countless objectives and requirements.

The present invention is directed to improving devices for a baby bottle holder and feeder in a manner which is safe, secure, economical and aesthetically pleasing.

For example, U.S. Pat. No. 5,135,189 to Ghazizadeh discloses a baby bottle holder comprising a means for gripping a baby bottle, a flexible arm member, a pivoting attachment with detents affixed to a spring actuated clamp. The means for gripping the baby bottle of the Ghazizadeh invention comprises two or more fingerlike portions engaging the base of the baby bottle having force applied thereupon by tension of a resilient member. And the flexible arm member of the Ghazizadeh invention comprises a spiral wrapped metal strip covered by a flexible decorative plastic tube. The Ghazizadeh flexible arm member is generally heavy in weight and susceptible to hazardous flailing when accelerated or decelerated as would be experienced in use of the invention in an automobile particularly during a collision. The present invention comprises a means for gripping a baby bottle employing a spring actuated clamp encircling and engaging the sides of the bottle and further comprises a flexible arm member forming an elongated hollow plastic articulating arm member. The advantages of the present invention are an ability to engage a variety of baby bottles, including those commonly available in animal and other unusual shapes, and furthermore a less hazardous lightweight flexible arm member is provided for holding the baby bottle.

In U.S. Pat. No. 4,957,253 to Roy et al. a baby bottle holder is disclosed. The Roy et al. invention comprises a large hooklike member engaging a neck of a person feeding a baby and furthermore having a pivoting bottle holding clasp adjustably disposed at a convenient site upon the wearers chest. The present invention is clampedly applied generally to a fixed object such as a side of a high chair or car seat and is not devised to be worn by a human for feeding a child.

In U.S. Pat. No. 5,037,046 to Mingledorff, Jr. an adjustable baby bottle holder is described comprising a frustro conical bottle holder adjustably supported by arm members affixed to leg members by pivotable ratcheting attachments. The Mingledorff Jr. invention has no provision for clamping the holder to a rigid object and is therefore of limited use in automobiles and is furthermore susceptible to being overturned by an active baby. The present invention clampedly affixes to rigid objects and is usable in an automobile as well as being substantially immune to disruption by an infant.

In U.S. Pat. No. 3,635,430 to Emond et al. a baby-feeding bottle holder is disclosed for holding a bottle or toy upon a baby in disposition for use. The Emond et al. invention comprises a curving straplike member having a bottle or toy disposed thereon by insertion within a series of slots therein. The Emond et al. invention is detachably fastened to the baby. A disadvantage in this prior art lies in a lack of provision for clamping the bottle holder to a rigid object. A second disadvantage is the potential strangulation hazard introduced by affixing a strap forming a collar around a baby. The present invention clampedly affixes to a rigid nearby object and is not affixed in any way to the baby. There is no apparent strangulation hazard within the present invention.

U.S. Pat. No. Des. 331,112 to Bachelor discloses the ornamental design of a baby bottle holder. The disclosure teaches an ornamental design having a bottle holder attached to an elongated handle member by a ball and socket means. The disclosure makes no provision for clampedly affixing the bottle holder to any object, rather the handle member is grasped. Furthermore, there are no provisions for articulating the handle member to provide greater flexibility. The present invention comprises an articulating arm having a bottle engaging spring loaded clamp at one end, and having a second clamp affixed to an opposite end thereof for the purpose of engaging a nearby object.

In this respect, the baby bottle holder and feeder according to the present invention substantially departs from the conventional concepts and designs of the prior art, and in so doing provides an apparatus primarily developed for the purpose of holding a baby bottle for substantially unattended feeding.

Therefore, it can be appreciated that there exists a continuing need for a new and improved baby bottle holder and feeder which can be employed to hold a bottle in close proximity to a baby for the purpose of substantially unattended feeding. In this regard, the present invention substantially fulfills this need.

As illustrated by the background art, efforts are continuously being made in an attempt to improve baby bottle holding devices. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of baby bottle holders and feeders now present in the prior art, the present invention provides an improved baby bottle holder and feeder construction wherein the same can be utilized for affixing a baby bottle to a rigid support and furthermore disposing the bottle within feeding reach of a nearby baby. As such, the general purpose of the present invention, which will be described subsequently in greater detail, is to provide a new and improved baby bottle holder and feeder apparatus and method which has all the advantages of the prior art baby bottle holders and feeders and none of the disadvantages.

The invention is defined by the appended claims with the specific embodiment shown in the attached drawings. For the purpose of summarizing the invention, the invention may be incorporated into a hollow articulating arm having a first clamp affixed at one end thereof and a second clamp affixed at a second end thereof. The first clamp is spring energized and engages a substantially rigid object near the baby. The second clamp comprises a pair of spring energized semi-cylindrical jaws which engage a baby bottle over a substantial surface portion thereof. In use the first clamp is attached to a rigid object such as a side portion of a child's automobile seat. A bottle may then be clamped between the jaws and the bottle may be positioned for convenient feeding by reshaping the articulating arm.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved baby bottle holder and feeder wherein the bottle is movably disposed by mounting upon an end of an articulating wherein the articulating arm is arm affixed at another end to a nearby object.

It is therefore an additional object of the present invention to provide a new and improved baby bottle holder and feeder which has all the advantages of the prior art baby bottle holders and feeders and none of the disadvantages.

It is another object of the present invention to provide a new and improved baby bottle holder and feeder which may be easily and efficiently manufactured and marketed.

It is a further object of the present invention to provide a new and improved baby bottle holder and feeder which is of a durable and reliable construction.

An even further object of the present invention is to provide a new and improved baby bottle holder and feeder which is susceptible of a low cost of manufacture with regard to both materials and labor, and which accordingly is then susceptible of low prices of sale to the consuming public, thereby making such baby bottle holders and feeders economically available to the buying public.

Still yet another object of the present invention is to provide a new and improved baby bottle holder and feeder which provides in the apparatuses and methods of the prior art some of the advantages thereof, while simultaneously overcoming some of the disadvantages normally associated therewith.

Still another object of the present invention is to provide a new and improved baby bottle holder and feeder which is lightweight and safe for use by infants and furthermore disposes a baby bottle at a convenient position for substantially unattended feeding of a young baby.

Yet another object of the present invention is to provide a new and improved baby bottle holder and feeder which is affixable to an usable within automobile child seats while the vehicle is in motion.

Even still another object of the present invention is to provide a new and improved baby bottle holder and feeder which is capable of releasing a baby bottle held therein by moderate force wherefore an older baby may become enabled of reaching for a bottle there attached and graspingly detaching the bottle for feeding.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration description makes reference to the annexed drawings wherein: is given to the following detailed description thereof. Such

DESCRIPTION OF THE PREFERRED EMBODIMENT

Figure 1:
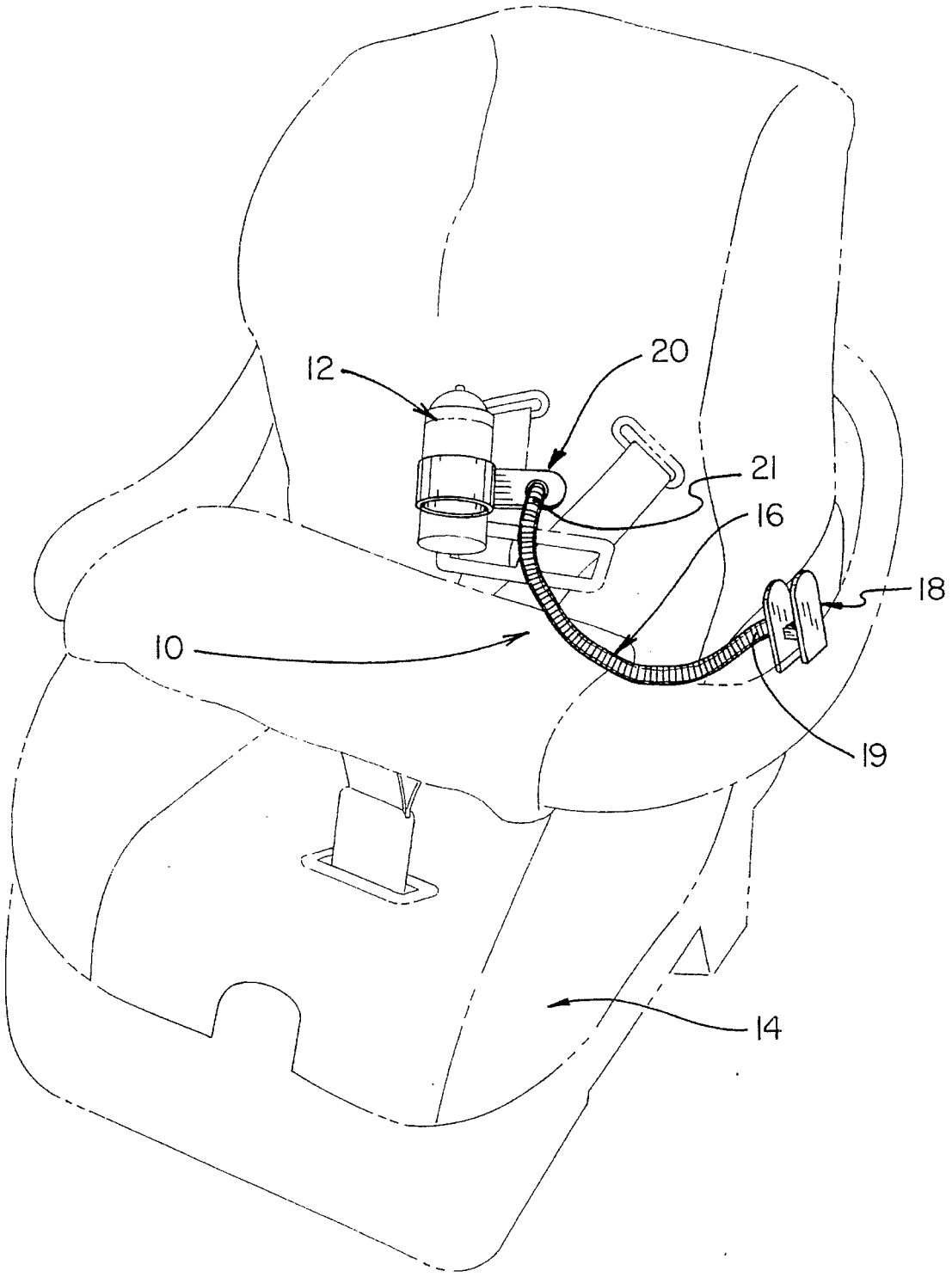
FIG. 1 is a perspective view of the baby bottle holder and feeder showing the mounting upon an automotive child seat.

With reference now to the drawings, and in particular to FIG. 1 thereof, a new and improved baby bottle holder and feeder embodying the principles and concepts of the present invention and generally designated by the reference numeral 10 will be described. From an overview standpoint, the baby bottle holder and feeder 10 is adapted for use with a baby bottle 12 and rigid structure 14 to support baby bottle 12 in a feeding position. The baby bottle holder and feeder 10 is useful with baby bottles 12 of various sizes and shapes, and furthermore is useful with baby bottles 12 in various states of fullness. See FIG. 1. Articulating arm 16 has a first clamp member 18 affixed to a first free end 19 thereof and a second clamp member 20 affixed to a second free end 21 thereof. Articulating arm 16 may be movably disposed by a baby to gain more or less access to baby bottle 12.

Figure 2:
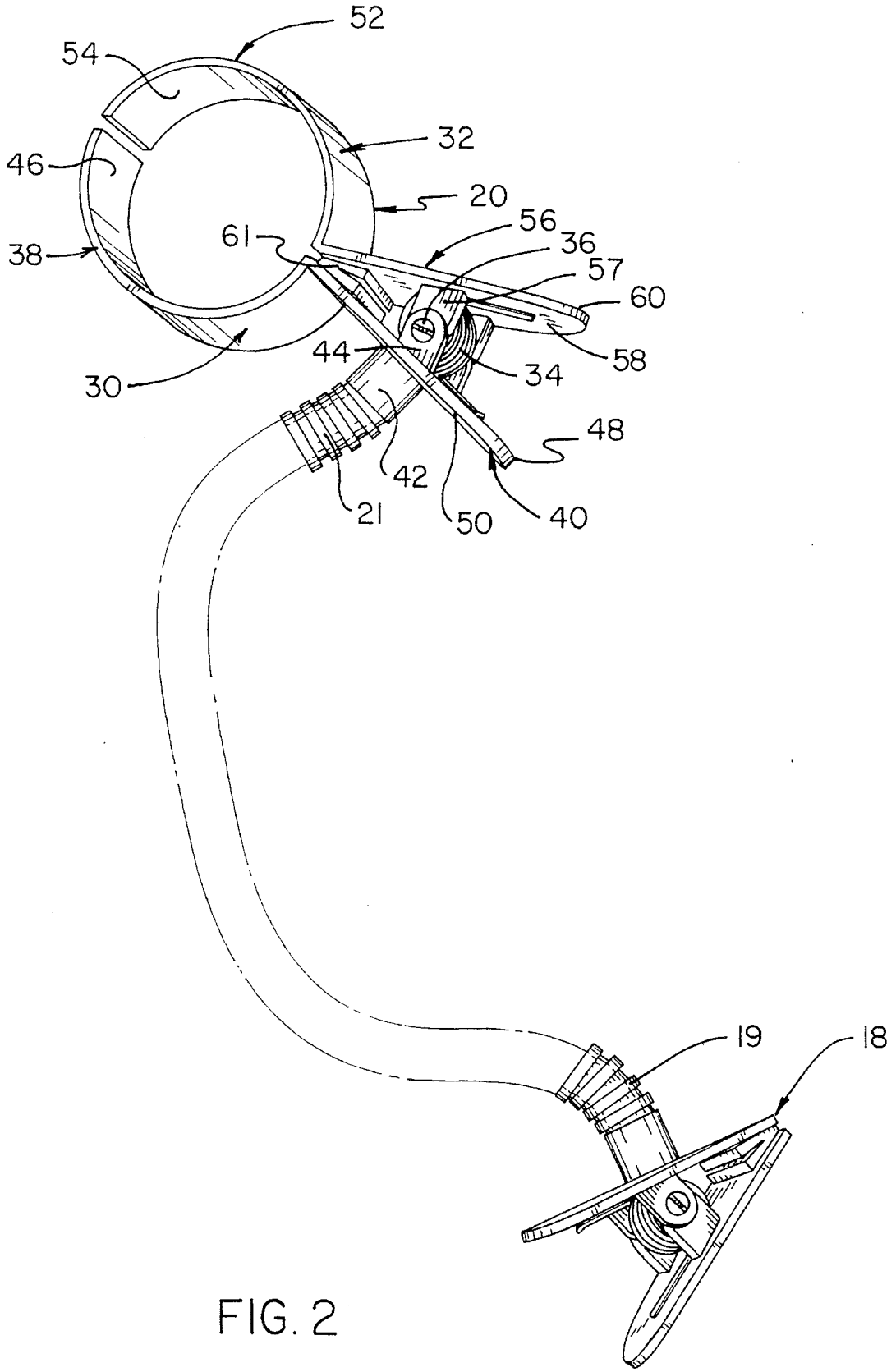
FIG. 2 is a perspective view of the baby bottle holder and feeder showing clamp members.

More specifically, it will be noted that the baby bottle holder and feeder 10 comprises an elongated articulating arm 16 having first clamp member 18 and second clamp member 20 disposed at opposing ends thereof. See FIG. 2. Clamp member 20 engages baby bottle 12 circumferentially over a substantial length thereof. Clamp member 20 comprises a first lever member 30, second lever member 32, spring 34, and axle 36. First lever member 30 comprises a curved portion 38, a flat portion 40, an articulating arm engagement portion 42, and a pivot support 44. Curved portion 38 engages a baby bottle upon a surface of concavity 46. Surface of concavity 46 may have a coating or covering disposed thereon for the purpose of enhancing the gripping capability of first lever member 30 acting cooperatively with second lever member 32.

Although a semicircular form is suitable for curved portion 38 other shapes, such as a series of flat segments each disposed at a fixed angular disposition to an adjacent portion, are equally feasible. Flat portion 40 comprises an extension of curved portion 38 disposed at an angle greater than ninety degrees to an immediate tangent to curved portion 38, and furthermore flat portion 40 has a free end 48 finished by a smoothly curving edge treatment. An outer portion 50 of flat portion 40 may have a grip enhancement pad or coating disposed thereon to provide improved engagement with an individual's thumb or forefinger whereupon pressure is applied to disengage first lever member 30 and second lever member 32 from a baby bottle 12 disposed therebetween. Second lever member 32 comprises a curved portion 52, a flat portion 56, and a pivot support 57.

Curved portion 52 engages a baby bottle 12 upon a surface of concavity 54. Surface of concavity 54, in similarity to surface of concavity 46, may have a coating or covering disposed thereon for the purpose of enhancing the gripping capability of second lever member 32 acting cooperatively with first lever member 30. Although a semicircular form is suitable for curved portion 52 other shapes, such as a series of flat segments each disposed at a fixed angular disposition to an adjacent portion, are equally feasible and furthermore curved portion 52 is generally a mirror image of curved portion 38. Flat portion 56 comprises an extension of curved portion 52 disposed at an angle greater than ninety degrees to an immediate tangent to curved portion 52, and furthermore flat portion 56 has a free end 58 finished by a smoothly curving edge treatment.

An outer portion 60 of flat portion 56 may have a grip enhancement pad or coating disposed thereon to provide improved engagement with an individual's thumb or forefinger whereupon pressure is applied to disengage second lever member 32 and first lever member 30 from a baby bottle 12 disposed therebetween. Pads 61 are adhesively applied to flat portions 40 and 56 to soften any impact occurring subsequent to removal of baby bottle 12. Spring 34 comprises a straight torsion spring of phospor-bronze, nickel alloy, steel, or plastic composition and may be enshrouded by a covering to preclude access to the spring 34 by a baby and furthermore the spring is firmly affixed to the baby bottle holder and feeder 10 to prevent loss and potential ingestion by an infant.

Figure 3:
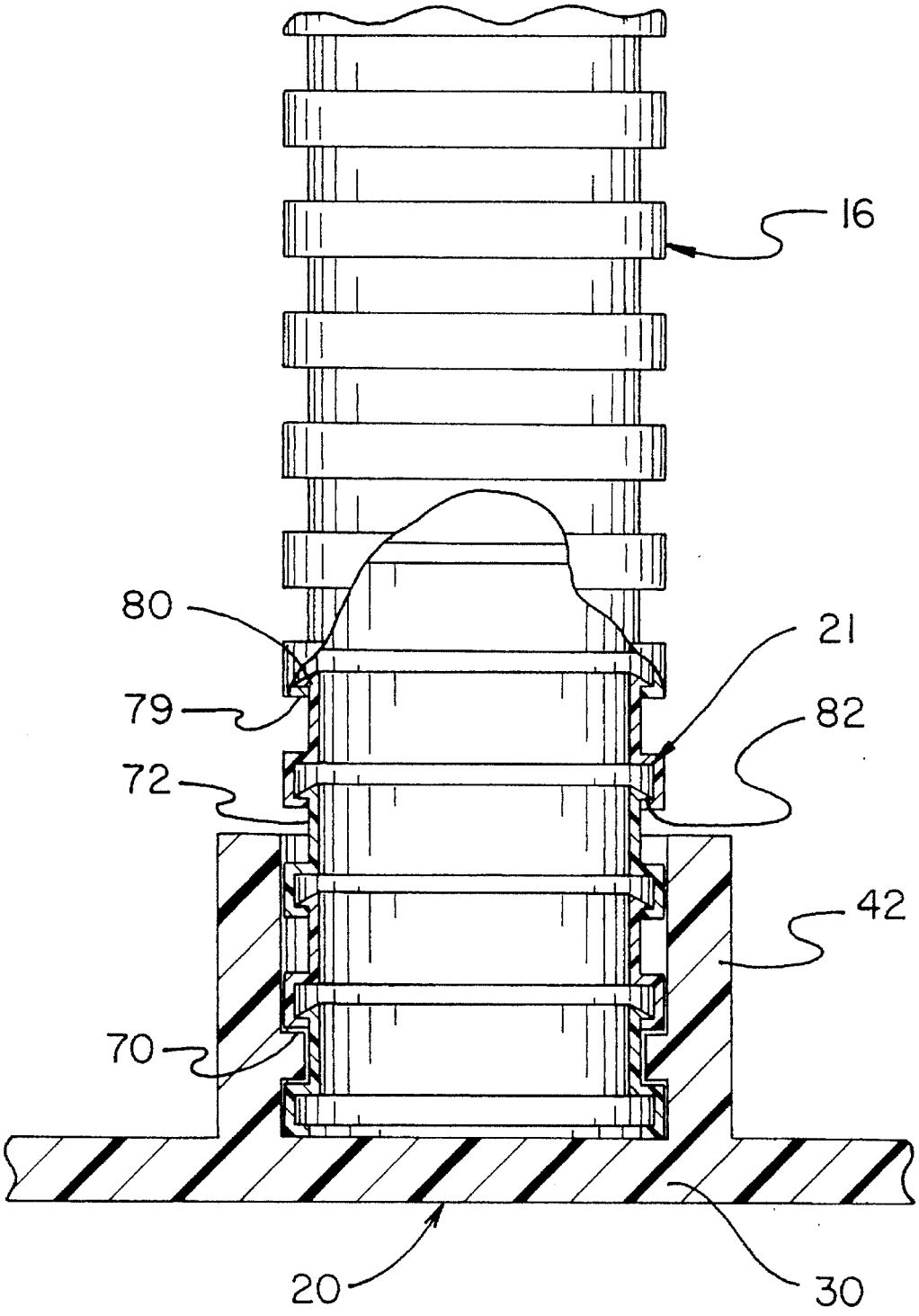
FIG. 3 is fragmentary cutaway view of the baby bottle holder and feeder showing the articulating arm member.

Spring 34 provides gripping force for first lever member 30 and second lever member 32 and generates the gripping force by application of an outwardly disposed moment upon flat portions 48 and 58 having a fulcrum comprising axle 36. Axle 36 is supported by pivot supports 44 and 57 wherein pivot supports 44 and 57 comprise flattened plates orthogonally affixed to respective flat portions 48 and 58 and furthermore having a substantially aligned hole disposed therein through which axle 36 passes. One or more holes disposed within pivot support 44 or 57 may have threads disposed therein to engage a threaded portion of axle 36, or axle 36 may comprise a rivet and be expanded at one or both ends thereof for retention, or axle 36 may be retained by one or more pin members disposed orthogonally through holes bored therethrough. Articulating arm engagement portion 42 comprises a ring member 70 bonded, molded, or otherwise permanently affixed to outer portion 50. See FIG. 3. Ring member 70 has a plurality of circular grooves 72 disposed therein for the purpose of retaining articulating arm 16 by engaging free end 21. Grooves 72 may be replaced by a threaded portion, however a locking means such as an adhesive is required to prevent undesirable disassembly thereof.

Articulated arm 16 comprises a hollow tubelike structure formed by engaging a plurality of rings 72 wherein ring 72 has an inside engaging portion 74 and an outside engaging portion 76. Inside engaging portion 74 comprises a circumferentially disposed portion having a barblike cross section which is forcibly introduced within an outside engaging portion of a second ring 78. Once an inside engaging portion 74 of a first ring 72 is inserted into a groovelike engagement portion 79 of second ring 78 the ring pair 72 and 78 are lockedly joined and are unable to be pulled apart except by employing damaging force.

Articulation resulting in a curving disposition of arm 16 is achieved by applying lateral pressure upon the arm 16 at a point a distance from free end 19 or at clamp member 30. Articulation of arm 16 is rendered feasible by the ability of engaging portion 74 to slidably engage a sidewall 80 of groovelike engagement portion 79 on a side opposing a force application side thereof and positively engaging a lip portion 82 disposed upon groovelike engagement portion 79. The resultant angular disposition of an axis of first ring 72 and an axis of second ring 78 is amplified by the quantity of rings forming articulated arm 16 and thereby produces a substantially flexible arm 16 having low mass and substantial strength.

Figure 4:
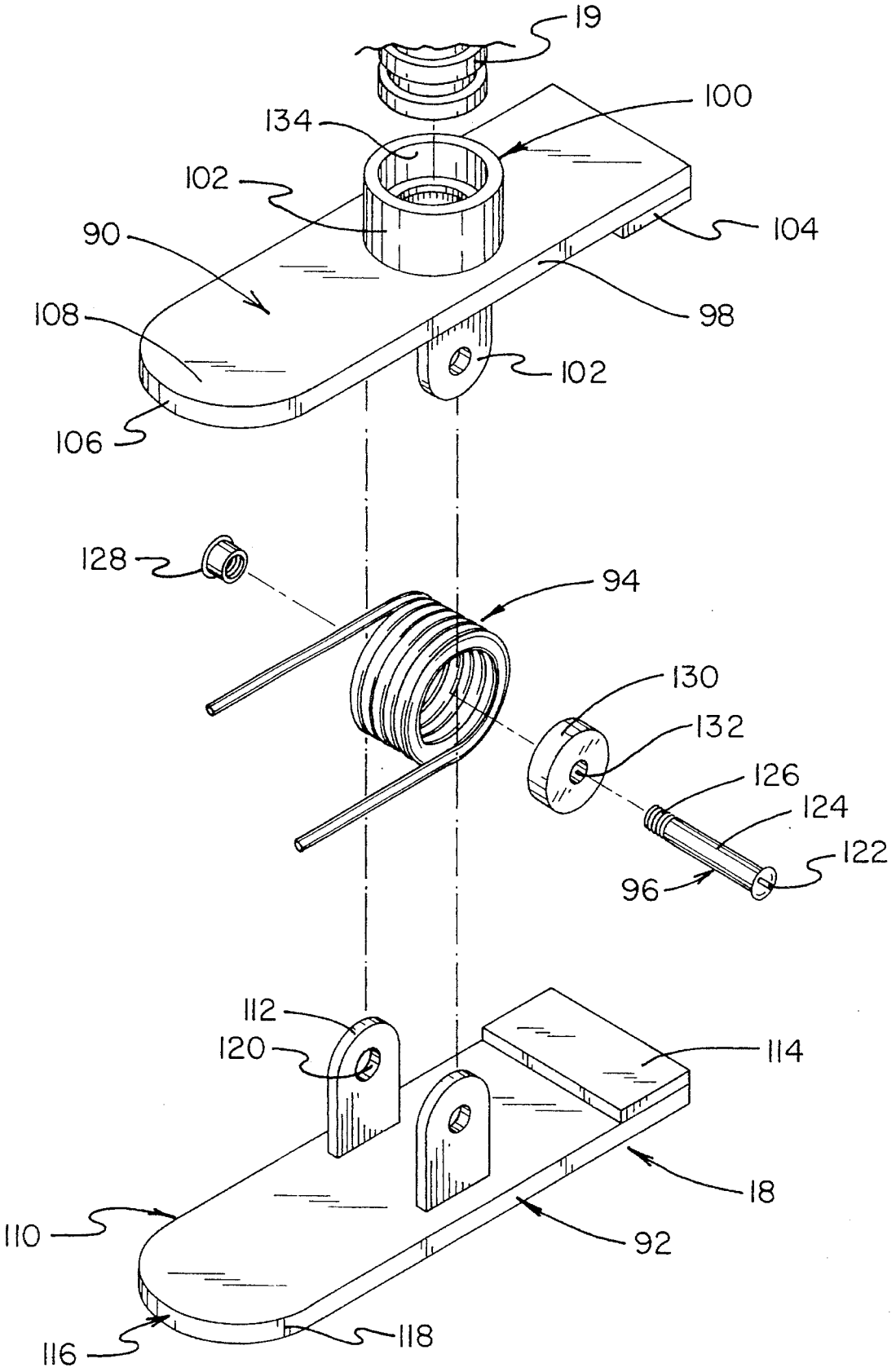
FIG. 4 is a fragmentary exploded view of the baby bottle holder and feeder showing a spring activated clamp member.

Clamp member 18 comprises a first lever member 90, second lever member 92, spring 94, and axle 96. First lever member 90 comprises a flat portion 98, an articulating arm engagement portion 100, a pivot support 102, and grip pad 104. See FIG. 4. Grip pad 104 comprises an adhesively fastened platelike member disposed upon a portion of flat portion 98 for the purpose of enhancing the gripping capability of first lever member 90 acting cooperatively with second lever member 92. Although a planar grip pad 104 form is suitable for grasping various objects other shapes, such as a series of grooves each disposed at a fixed angular disposition to an adjacent portion thereby forming a curved average surface presentation, are equally feasible. Flat portion 98 has a free end 106 finished by a smoothly curving edge treatment and furthermore an outer portion 108 of flat portion 98 may have a grip enhancement pad or coating disposed thereon to provide improved engagement with an individual's thumb or forefinger whereupon pressure is applied to disengage first lever member 90 and second lever member 92 from a portion of rigid structure 14 disposed therebetween. Second lever member 92 comprises a flat portion 110, a pivot support 112, and a grip pad 114.

Grip pad 114 comprises an adhesively fastened platelike member disposed upon a portion of flat portion 110 for the purpose of enhancing the gripping capability of second lever member 92 acting cooperatively with first lever member 90. Although a planar grip pad 114 form is suitable for grasping various objects other shapes, such as a series of grooves each disposed at a fixed angular disposition to an adjacent portion thereby forming a curved average surface presentation, are equally feasible. Flat portion 110 has a free end 116 finished by a smoothly curving edge treatment. An outer portion 118 of flat portion 110 may have a grip enhancement pad or coating disposed thereon to provide improved engagement with an individual's thumb or forefinger whereupon pressure is applied to disengage second lever member 92 and first lever member 90 from a portion of a rigid structure 14 disposed therebetween. Spring 94 comprises a straight torsion spring of phospor-bronze, nickel alloy, steel, or plastic composition and may be enshrouded by a covering to preclude access to the spring 94 by a baby and furthermore the spring is firmly affixed to the baby bottle holder and feeder 10 to prevent loss and potential ingestion by an infant.

Spring 94 provides gripping force for first lever member 90 and second lever member 92 and generates the gripping force by application of an outwardly disposed moment upon flat portions 98 and 110 having a fulcrum comprising axle 96. Axle 96 is supported by pivot supports 102 and 112 wherein pivot supports 102 and 112 comprise flattened plates orthogonally affixed to respective flat portions 98 and 110 and furthermore having a substantially aligned hole 120 disposed therein through which axle 96 passes. Axle 96 may comprise a bolt having a head 122, a cylindrical body 124, and a threaded portion 126 wherein restraining nut 128 is threadedly applied thereto. Or one or more holes disposed within pivot support 102 or 112 may have threads disposed therein to engage a threaded portion of axle 96, or axle 96 may comprise a rivet and be expanded at one or both ends thereof for retention, or axle 96 may be retained by one or more pin members disposed orthogonally through holes bored therethrough. Spacer 130 comprises a perforated disc having a central hole 132 loosely engaging axle 96 disposed therein and furthermore spacer 130 is disposed between innermost pivot supports within the free space of spring 94 for the purpose of uniformly retaining the spring 94. Articulating arm engagement portion 100 comprises a ring member 102 bonded, molded, or otherwise permanently affixed to outer portion 108. Ring member 102 has a plurality of circular grooves 134 disposed therein for the purpose of retaining articulating arm 16 by engaging free end 19. Grooves 134 may be replaced by a threaded portion , however a locking means such as an adhesive is required to prevent undesirable disassembly thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by LETTERS PATENT of the United States is as follows:

1. A baby bottle holder and feeder for the purpose of holding a baby bottle for substantially unattended feeding comprising:

a first clamp member engaging a baby bottle wherein said first clamp member comprises a pair of opposing jaws engaging said baby bottle with a straight torsional spring therebetween;

a second clamp member engaging an existing object;

an articulating arm member interconnecting said first clamp member and said second clamp member wherein said articulating arm member comprises a plurality of hollow tubular sections in engaging relationship;

a first one of said opposing jaws having a substantially semi-cylindrical baby bottle engaging portion and a planar extension thereof wherein said planar extension is disposed at an angle greater than ninety degrees to an immediate tangent of said semi-cylindrical engaging portion;

a second one of said opposing jaws having a substantially semi-cylindrical baby bottle engaging portion and a planar extension thereof wherein said planar extension of said second opposing jaw is disposed at an angle greater than ninety degrees to an immediate tangent of said semi-cylindrical engaging portion of said second opposing jaw and furthermore said planar extension of said second opposing jaw has an articulating arm engagement means disposed upon a surface thereof;

pivoting means hingedly interconnecting said first opposing jaw and said second opposing jaw;

said straight torsion spring substantially axially coincident with a rotational axis of said pivoting means and unceasingly applying force attempting to maintain closure of said first and second opposing jaws;

a plurality of orthogonally disposed plates having a through hole therein affixed in opposition upon said planar extensions of first and second opposing jaws and furthermore the through holes of said orthogonally disposed plates are substantially axially aligned and have an axle member disposed therein; and each of said planar extensions of said first and second opposing jaws comprising a pad attached to an underside surface thereof adjacent the semi-cylindrical baby bottle engaging portion; wherein the pads are disposed across from one another so that the pads presses against one another subsequent to removal of the baby bottle from the semi-cylindrical portions for softening impact occuring due to the closing of the first and second opposing jaws.

* * * * *